US006686883B2

(12) United States Patent
Fujiwara

(10) Patent No.: US 6,686,883 B2
(45) Date of Patent: Feb. 3, 2004

(54) ANTENNA

(75) Inventor: Masanao Fujiwara, Tokyo (JP)

(73) Assignees: Micro FT Co., Ltd., Tokyo (JP); Excel Engineering Co., Ltd., Tokyo (JP)

( * ) Notice: Subject to any disclaimer, the term of this patent is extended or adjusted under 35 U.S.C. 154(b) by 12 days.

(21) Appl. No.: 10/183,467

(22) Filed: Jun. 28, 2002

(65) Prior Publication Data

US 2003/0001788 A1 Jan. 2, 2003

(30) Foreign Application Priority Data

Jun. 28, 2001 (JP) ..... 2001-196602

(51) Int. Cl.[7] ..... H01Q 1/38
(52) U.S. Cl. ..... 343/700 MS; 343/846
(58) Field of Search ..... 343/700 MS, 702, 343/846, 848

(56) References Cited

U.S. PATENT DOCUMENTS 5,861,854 A * 1/1999 Kawahata et al. ..... 343/702
6,040,806 A * 3/2000 Kushihi et al. ..... 343/853
6,304,220 B1 * 10/2001 Herve et al. ..... 343/700 MS
6,353,443 B1 * 3/2002 Ying ..... 345/702

* cited by examiner

*Primary Examiner*—Tan Ho
(74) *Attorney, Agent, or Firm*—Kubovcik & Kubovcik

(57) ABSTRACT

A transmission antenna is formed on a transmission-sided board as an electric conducting pattern having a length of ¼(λ/4)±20% of a wavelength, where the transmission-sided board mounts thereon a transmission circuit used in a frequency range defined from 700 [MHz] to 3 [GHz], and a portion of the transmission antenna, which is longer than, or equal to ⅔ of an entire length of the transmission antenna, owns a width wider than, or equal to λ/400. And, an reception antenna is formed on a reception-sided board 202 as an electric conducting pattern having a length of ¼(λ/4) ±20% of a wavelength, where the reception-sided board mounts thereon a reception circuit used in a frequency range defined from 700 [MHz] to 3 [GHz], and a portion of the reception antenna, which is longer than, or equal to ⅔ of an entire length of the reception antenna, owns a width wider than, or equal to λ/400.

6 Claims, 2 Drawing Sheets

ANTENNA

BACKGROUND OF THE INVENTION

1. Technical Field

This invention is related to an antenna formed on a printed circuit board which mounts a transmission circuit and/or a reception circuit of an apparatus such as a portable telephone and a transceiver for wireless communicating information, in which information is transmitted from the apparatus via the antenna, and/or information is received by the apparatus via the antenna.

2. Description of the Prior Art

Since portable telephones are rapidly popularized in recent years, needs of wireless information communication apparatus are considerably increased, and also, various sorts of wireless (mobile) information communication services are considered by which these wireless information communication apparatus may be presently made compact and in low cost, and also new markets may be established. On the other hand, desires (needs) as to users who perform wireless information communications are how these users can utilize such wireless information communications in lower cost, easier manners, while securing high reliability as well as high security.

Various technical aspects should be considered in conventional wireless information communication apparatus operable under severe communication environments caused by strong variations, and also in conventional portable communication terminals its apparatus size should be made compact so as to improve portabilities thereof.

As one of key technologies related to the above-explained considering aspects, there are antennas. An antenna is an apparatus which is employed so as to radiate transmission output (power) derived from a transmission-sided apparatus to aerial space as electromagnetic waves, or in order to receive electromagnetic waves from the aerial space as an input to a reception-sided apparatus. Normally, antennas may be operated in similar manners even in any case of transmission antennas and reception antennas, namely these antennas may have a reversible characteristic. However, since electric power levels handled by antennas during reception are extremely low, as compared with electric power levels handled by these antennas during transmission, these antennas may be separately constituted with respect to transmission sides and reception sides.

In general, sleeve antennas and helical antennas are employed as antennas used in wireless (radio) information communication apparatus. As a specially-designed antenna, a slim type antenna (plane antenna) and the like may be also provided. While this slim type antenna is provided on a dielectric board and the like, a thickness of this slim type antenna is made thinner than, or equal to several [cm], namely not-appeal structure, and also, this slim type antenna is mainly utilized in such frequency ranges higher than, or equal to the UHF frequency range (300 [MHz] to 3 [GHz]). Among these antennas, there is an antenna that may be made compact in such a manner that since one end of this antenna is grounded via a capacitor and the like, a length "L" of this antenna is made equal to a ¼ of a wavelength "λ" to be handled ($L=\lambda/4$).

SUMMARY OF THE INVENTION

However, in case that an antenna used in a mobile wireless communication was an antenna such as a sleeve antenna which was arranged at an external portion of a mobile wireless communication apparatus, there was a problem. That is, when this sleeve antenna was touched, the antenna characteristic was easily and adversely influenced by a change in directivity and a phenomenon such as a body effect. Also, in the conventional slim type antenna, when a metal piece and the like were located in the vicinity of this slim type antenna, there was such a problem that an antenna characteristic of this slim type antenna was changed. Namely, reflections of transmission outputs from this slim type antenna were increased. Furthermore, in conventional wireless information communication apparatus having portability, the size of the antenna relative to the size of the wireless information communication apparatus is large. There is a need for above-described antennas that can clear the standards as to antenna performance, and also are made compact.

This invention has been made to solve the above-explained problems, and therefore, has an object to provide an antenna capable of being mounted on a compact wireless information communication apparatus and being operated under stable condition without being influenced by a change of directivity and a phenomenon such as a body effect.

To achieve the above-explained object, an antenna of this invention is featured by such an antenna used in a frequency range defined from 700 [MHz] to 3 [GHz] wherein: the antenna is formed on a printed circuit board as an electric conducting pattern having a length of ¼ ($\lambda/4$)±20 [%] of a wavelength λ, where the printed circuit board mounts thereon a transmission circuit used in the frequency range; and a portion of the antenna, which is longer than, or equal to ⅔ of an entire length of the antenna, owns a width wider than, or equal to $\lambda/400$.

To achieve the above-explained object, an antenna of this invention is featured by such an antenna used in a frequency range defined from 700 [MHz] to 3 [GHz] wherein: the antenna is formed on a printed circuit board as an electric conducting pattern having a length of ¼ ($\lambda/4$)±20 [%] of a wavelength λ, where the printed circuit board mounts thereon a reception circuit used in the frequency range; and a portion of the antenna, which is longer than, or equal to ⅔ of an entire length of the antenna, owns a width wider than, or equal to $\lambda/400$.

The antenna of this invention is formed as the electric conducting pattern on the printed circuit board which mounts the transmission circuit and/or the reception circuit. As a consequence, the antenna space of this antenna can be made smaller than the conventional antenna space, and a total manufacturing stage of this antenna can be reduced. Further, an antenna operable under stable condition can be provided, and also, the size of the apparatus on which this antenna is mounted can be made compact.

EMBODIMENT MODE OF THE INVENTION

In an antenna according to a preferred embodiment mode of the present invention, the portion of the above-described antenna longer than, or equal to ⅔ of the entire length thereof is separated from either a ground portion formed on the printed circuit board or the above-described transmission circuit, longer than, or equal to $\lambda/400$. The above-described antenna is formed as an electric conducting pattern on the printed circuit board which mounts thereon the transmission circuit, while being separated by said distance of at least $\lambda/400$. Also, while transmission output terminal portions are provided on the antenna and the ground portion, the transmission output terminal portion are capable of measuring a transmission output from the transmission circuit, and the antenna is further comprised of a switching portion for switching as to whether or not the antenna is electrically conducted to the transmission circuit.

In an antenna according to a preferred embodiment mode of the present invention, the portion of the above-described antenna longer than, or equal to ⅔ of the entire length thereof is separated from either a ground portion formed on the printed circuit board or the above-described reception circuit, longer than, or equal to λ/800. The above-described antenna is formed as an electric conducting pattern on the printed circuit board which mounts thereon the reception circuit, while being separated by said distance of at least λ/800. Also, while reception input terminal portions are provided on the antenna and the ground portion, the reception input terminal portions are capable of inputting a reception signal into the reception circuit, and also, the antenna is further comprised of a switching portion for switching as to whether or not the antenna is electrically conducted to the reception circuit.

DESCRIPTION OF REFERENCE NUMERALS

101: transmission antenna, 102: transmission-sided board, 103: ground portion, 104*a:* antenna-sided switching point, 104*b:* transmission circuit-sided switching point, 105*a:* transmission output measuring port, 105*b:* transmission output measuring ground port, 201: reception antenna, 202: reception-sided board, 203: ground portion, 204*a:* antenna-sided switching point, 204*b:* reception circuit-sided switching point; 205*a:* reception input measuring portion, 205*b:* reception input measuring ground portion.

Embodiment

Next, an embodiment of this invention will now be explained in detail with reference to drawings.

First Embodiment

Figure 1:
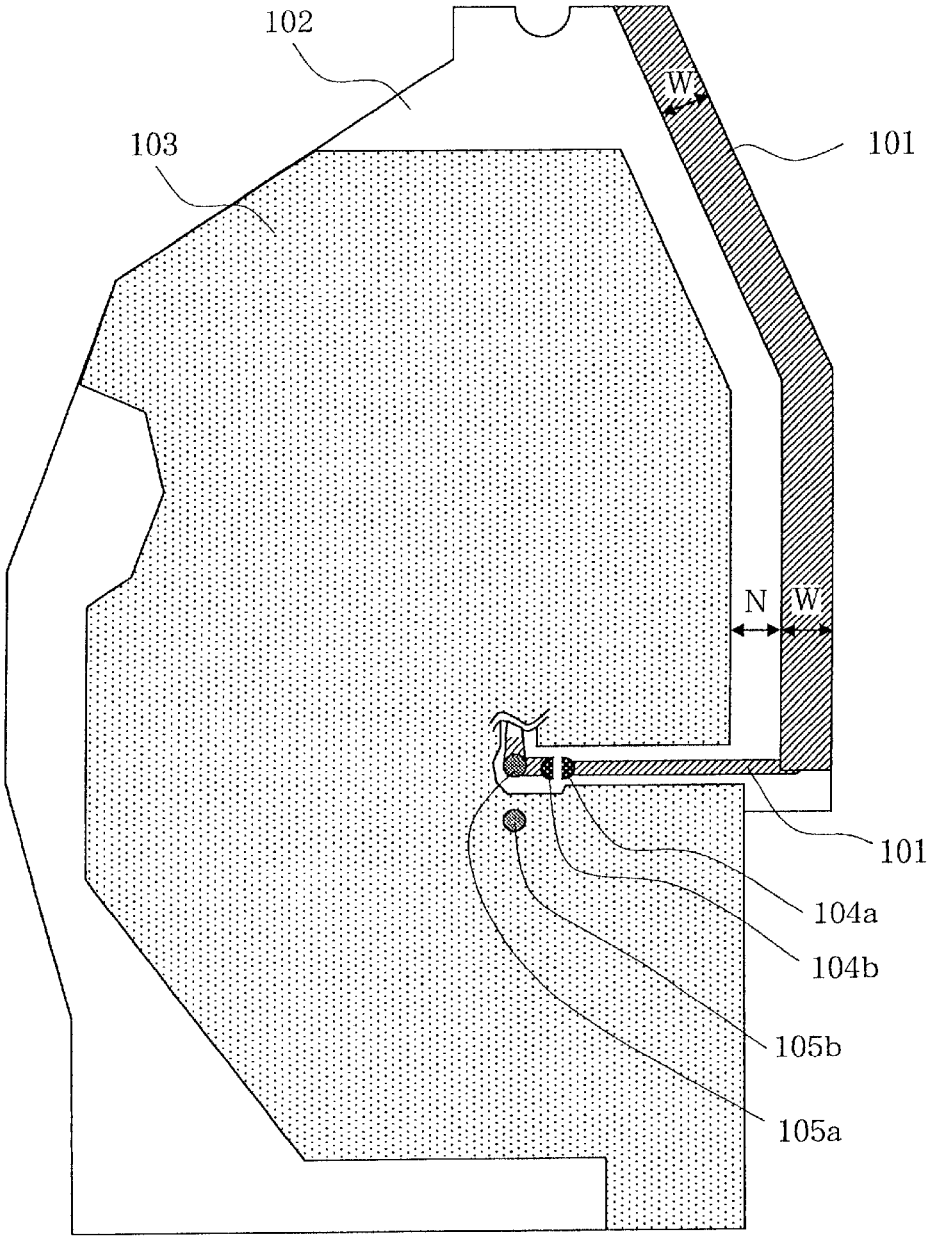
FIG. 1 is a diagram for indicating the construction of an antenna (transmission antenna), according to a first embodiment of this invention, which is formed on a printed circuit board as an electric conducting pattern.

FIG. 1 is a diagram for indicating a structure of an antenna (transmission antenna) which is formed as an electric conducting pattern on a printed circuit board, according to a first embodiment of the present invention. This transmission antenna is mounted on the printed circuit board, which mounts thereon a transmission circuit and the like and is provided in a wireless (radio) information communication apparatus.

In FIG. 1, a transmission antenna 101 is an antenna for radiating an information signal (transmission output) to be derived from the wireless information communication apparatus as electromagnetic waves to aerial space. The transmission antenna 101 is formed on the printed circuit board which mounts thereon the transmission circuit and the like as an electric conducting pattern such as a copper foil in a similar manner to a portion (ground portion and the like, will be explained later) which is formed as another pattern. A transmission-sided board 102 is a printed circuit board which mounts thereon a transmission circuit (not shown). This transmission circuit is equipped with a modulation circuit, an oscillation circuit, a high frequency (radio frequency) amplification circuit, and the like. The modulation circuit modulates an input signal entered into the wireless information communication apparatus by way of, for example, a modulation system such as a spread spectrum modulation system, a phase shift keying modulation system, and an FM modulation system. The oscillation circuit is employed so as to transmit the modulated signal at a center frequency of, for example, 906 [MHz]. In this embodiment, this transmission-sided board 102 is a dielectric board, and thus, the conventional circuit boards may be employed which are made of thermosetting phenol resin, epoxy resin, and glass etc. Also, a ground portion 103 corresponds to a ground pattern of the above-described transmission circuit and transmission antenna 101. The ground portion 103 may be preferably formed on the printed circuit board in such a manner that this ground portion 103 surrounds the transmission circuit in order to avoid interference occurred between the transmission antenna 101 and the transmission circuit. Furthermore, either an entire portion or a portion of the above-described transmission circuit (not shown) is provided on the transmission-sided board 102.

Both an antenna-sided switching portion 104*a* and a transmission circuit-sided switching portion 104*b* are used to switch as to whether or not the transmission antenna 101 is operated as an antenna. These antenna-sided switching portion 104*a* and transmission circuit-sided switching portion 104*b* constitute a switching unit in this embodiment. In case that the transmission antenna 101 is operated as the antenna, the antenna-sided switching portion 104*a* is melting-connected to the transmission circuit-sided switching portion 104*b* by using solder so that the transmission antenna 101 is electrically conducted to the transmission circuit. Also, in the case that the antenna-sided switching portion 104*a* and the transmission circuit-sided switching portion 104*b* remain opened, the transmission antenna 101 is not operated as the antenna, but when the transmission circuit is tested and investigated, the transmission circuit can be adjusted and also the data thereof can be acquired.

Both a transmission output measuring port 105*a* and a transmission output measuring ground port 105*b* correspond to a termination point and a ground point, from which a transmission signal is outputted when the transmission circuit is adjusted and the data is acquired while the above-explained transmission circuit is tested and investigated. Both the transmission output measuring portion 105*a* and the transmission output measuring ground portion 105*b* constitute transmission output terminal portions in this embodiment.

Both the ground portion 103 and the transmission circuit (not shown in FIG. 1) may be provided on one surface of the transmission-sided board 102, or may be provided on both surfaces of this transmission-sided board 102. In other words, as the transmission-sided board 102, either a single-plane printed circuit board or a double-plane printed circuit board may be employed. Also, in this embodiment, the transmission antenna 101, both the antenna-sided switching portion 104*a* and the transmission circuit-sided switching portion 104*b,* and also, both the transmission output measuring portion 105*a* and the transmission output measuring ground portion 105*b* are formed in patterns only on a single plane of the transmission-sided board 102 even in such a case that the transmission-sided board 102 is a double-plane printed circuit board.

Next, the transmission antenna 101 will now be explained more in detail. The transmission antenna 101 is tuned in such a manner that both a length and a width of this transmission antenna 101 are made coincident with a center frequency of a transmission signal. Concretely speaking, assuming now that the center frequency "f" of the transmission signal is defined by $f=906\times10^6$ [Hz], a length (resonant length) "L" of the transmission antenna 101 may be conducted by the below-mentioned formula 1, since a wavelength "λ" is equal to $3\times10^8/f$ [m].

$$L=\lambda/4=3\times10^8/(906\times10^6\times4)\approx8.28\ [\text{cm}] \qquad \text{[Formula 1]}$$

A shortening ratio of the length "L" of the transmission antenna 101 with respect to the width "W" thereof is made different, while this shortening ratio is to shorten the length "L", as compared with "λ/4". In other words, the length "L" of this transmission antenna 101 may be formed as electric conducting patterns on the transmission-sided board 102 within a range defined by λ/4±20 [%]. In FIG. 1, it is so assumed that such a portion of the transmission antenna 101, which is longer than, or equal to ⅔ of an entire length of this transmission antenna 101, is used as a major portion of this transmission antenna 101, where this portion owns the width "W" of, for example, 4 [mm], and mainly functions as a resonator used to radiate transmission output as electromagnetic waves to aerial space. This major portion may be tuned to a rectangular shape, and formed as a pattern on the transmission-sided board 102. Alternatively, this major portion may be tuned to an arc shape, and formed as a pattern on the transmission-sided board 102. As a result, this major portion may be suitably provided in accordance with the shape of the transmission-sided board 102.

A center frequency of a transmission signal and a radiation direction of the transmission signal are determined based upon both the length of the transmission antenna 101 and the width "W" of the major portion, where the transmission signal is outputted by energizing the transmission antenna 101. An interval "N" corresponding to such a closemost distance on the transmission-sided board 102, which is defined between the major portion of the transmission antenna 101 and the ground portion 103, is made equal to the width "W" of the transmission antenna 101, or made longer than this width "W". Naturally, as to the transmission circuit and the major portion of the transmission antenna 101, such an interval "N" is made equal to the width "W" of the transmission antenna 101, or made longer than this width "W". In an actual case, the interval "N" may be preferably set to be longer than, or equal to "λ/400". Since the distance of the interval "N" defined between the major portion of the transmission antenna 101 and either the ground portion 103 or the transmission circuit is set to the above-described distances, reflections of the transmission output can be extremely lowered.

Practically speaking, an antenna characteristic (for example, resonant condition of antenna) is similarly influenced by a thickness of a printed circuit board used to mount thereon the transmission antenna 101, and also, a dielectric constant owned by the printed circuit board. As a consequence, in this embodiment, the length "L" and the width "W" of the transmission antenna 101 are tuned so as to be fitted to the center frequency and the like of the transmission signal by considering these aspects, and the transmission antenna 101 is formed as the pattern on the transmission-sided board 102. It could be confirmed that this transmission antenna 101 can be operated under stable condition within a frequency range defined from 700 [MHz] to 3 [GHz], while this frequency range is, for example, a 900 [MHz]range in which 906 [MHz] is a center frequency thereof.

Second Embodiment

Figure 2:
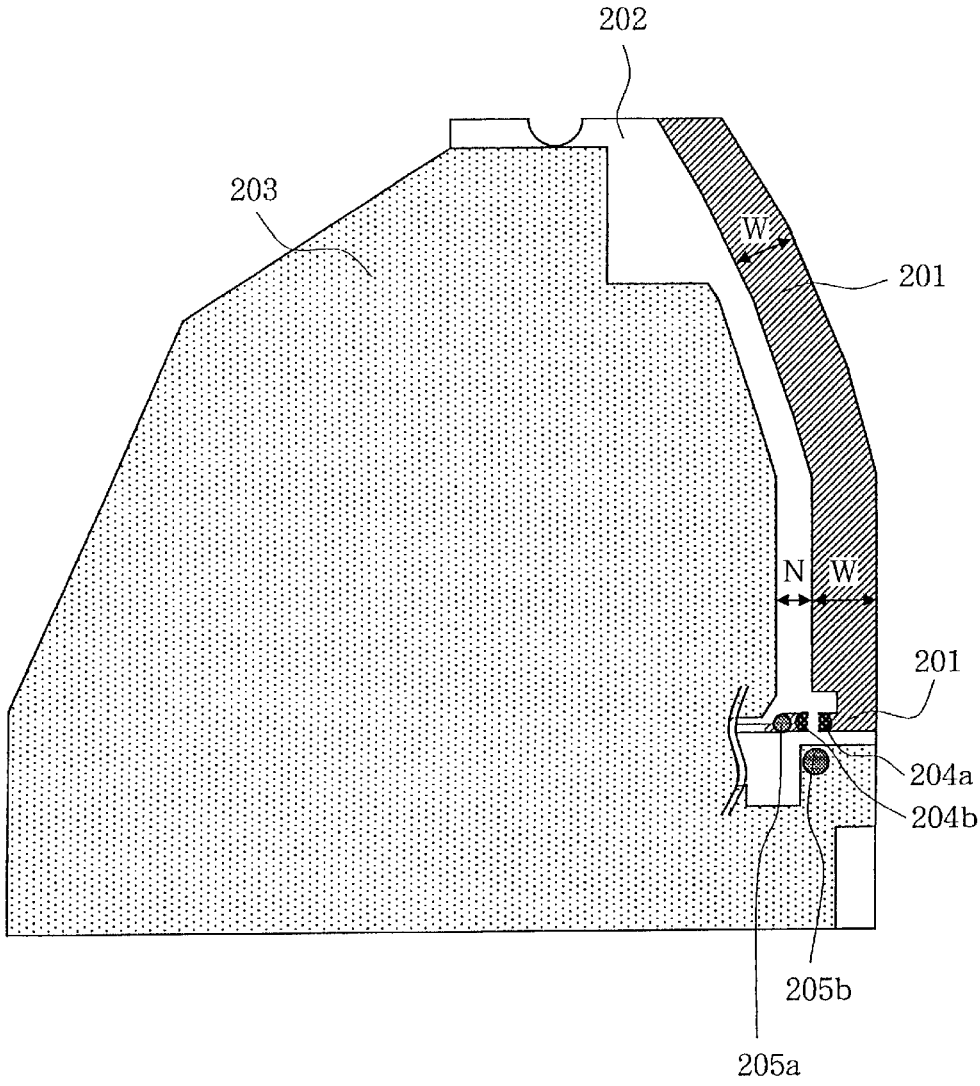
FIG. 2 is a diagram for indicating the construction of an antenna (reception antenna), according to a second embodiment of this invention, which is formed on a printed circuit board as an electric conducting pattern.

FIG. 2 is a diagram for indicating a structure of an antenna (reception antenna) which is formed as an electric conducting pattern on a printed circuit board, according to a second embodiment of the present invention. This reception antenna is mounted on the printed circuit board, which mounts thereon a reception circuit and the like and is provided in a wireless (radio) information communication apparatus.

In FIG. 2, a reception antenna 201 corresponds to such an antenna for receiving an information signal transmitted wirelessly to the wireless information communication apparatus as input. Similar to other pattern-formed portions (ground portion and the like, will be discussed later), the reception antenna 201 is formed on the printed circuit board which mounts thereon the reception circuit and the like as an electric conducting pattern such as a copper foil. A reception-sided board 202 corresponds to such a printed circuit board which mounts thereon an intermediate frequency amplification circuit, a local oscillation circuit, a demodulation circuit, and the like. The intermediate frequency amplification circuit converts a carrier frequency (for example, center frequency of 906 [MHz]) into intermediate frequency as to an information signal received from the reception antenna 201. The demodulation circuit demodulates an input signal by way of, for instance, a demodulation system such as a despread spectrum demodulation system, a phase shift keying demodulation system, and an FM demodulation system. In this embodiment, this reception-sided board 202 is a dielectric board, and therefore, the conventional printed circuit boards made of thermosetting phenol resin, epoxy resin, and glass etc. may be employed. A ground portion 203 corresponds to a ground pattern of the above-described reception circuit and reception antenna 201, and is formed on the reception-sided board 202. Furthermore, either an entire portion or a portion of the above-described reception circuit (not shown) is provided on the reception-sided board 202.

Both an antenna-sided switching portion 204*a* and a reception circuit-sided switching portion 204*b* are used to switch as to whether or not the reception antenna 201 is operated as an antenna. These antenna-sided switching portion 204*a* and reception circuit-sided switching portion 204*b* constitute a switching unit in this embodiment. In the case that the reception antenna 201 is operated as the antenna, the antenna-sided switching point 204*a* is melting-connected to the reception circuit-sided switching portion 204*b* by using solder so that the reception antenna 201 is electrically conducted to the reception circuit. On the other hand, in the case that both the antenna-sided switching portion 204*a* and the reception circuit-sided switching portion 204*b* remain opened, the reception antenna 201 is not operated as the antenna, but when the reception circuit is tested and investigated, the reception circuit can be adjusted and also the data can be acquired.

Both a reception input measuring portion 205*a* and a reception input measuring ground portion 205*b* correspond to a terminal (starting) point and a ground point, into which a reception signal is inputted when the reception circuit is adjusted and the data is acquired while the above-explained reception circuit is tested and investigated. Both the reception input measuring port 205*a* and the reception input measuring ground port 205*b* constitute reception input terminal portions.

Both the ground portion 203 and the reception circuit (not shown in FIG. 1) may be provided on one surface of the reception-sided board 202, or may be provided on both surfaces of this reception-sided board 202. In other words, as the reception-sided board 202, either a single-plane printed circuit board or a double-plane printed circuit board may be employed. In this embodiment, the reception antenna 201, both the antenna-sided switching portion 204*a* and the reception circuit-sided switching portion 204*b*, and also, both the reception input measuring port 205*a* and the reception input measuring ground port 205*b* are formed in patterns only on a single plane of the reception-sided board 202 even in such a case that the reception-sided board 202 is a double-plane printed circuit board.

Next, the reception antenna 201 will now be explained more in detail. The reception antenna 201 is tuned in such a manner that both a length and a width of this reception antenna 201 are made coincident with a center frequency of a transmission signal. Concretely speaking, similar to the length of the transmission antenna in the above-described first embodiment, in the case that a center frequency of a wireless transmission signal is equal to 906 [MHz], a length (resonant length) "L" of the reception antenna 201 is conducted based upon the formula 1.

A shortening ratio of the length "L" of the reception antenna 201 with respect to the width "W" thereof is made different, while this shortening ratio is to shorten the length "L", as compared with "λ/4". In other words, the length "L" of this reception antenna 201 may be formed as electric conducting patterns on the reception-sided board 202 within a range defined by λ/4±20 [%]. In FIG. 2, it is so assumed that such a portion of the reception antenna 201, which is longer than, or equal to ⅔ of an entire length of this reception antenna 201, is used as a major portion of this reception antenna 201, where this portion owns the width "W" of, for example, 5 [mm], and mainly functions as a resonator used to input electromagnetic waves from aerial space. This major portion may be tuned to an arc shape and formed as a pattern on the reception-sided board 202. Alternatively, this major portion may be tuned to a rectangular shape and formed as a pattern on the reception-sided board 202. As a result, this major portion may be suitably provided in accordance with the shape of the reception-sided board 202.

Both the length of the reception antenna 201 and the width "W" of the major portion may determine such a fact that the center frequency of the transmission signal received by the reception antenna 201 and energy of electromagnetic waves received by this reception antenna 201 can be absorbed as the antenna at how degree of high sensitivities. An interval "N" corresponding to such a closemost distance on the reception-sided board 202, which is defined between the major portion of the reception antenna 201 and the ground portion 203, is made equal to a half of this width "W" of the major portion of the major portion of the reception antenna 201, or made longer than this ½ width "W". Apparently, as to the reception circuit and the major portion of the reception antenna 201, such an interval "N" is made equal to a half of this width "W" of the major portion of the reception antenna 201, or made longer than this ½ width "W". In an actual case, these intervals "N" may be preferably set to be longer than, or equal to "λ/800". In the reception case, since an radio wave is not radiated, the distance of the interval "N" between the major portion of the reception antenna 201 and either the ground portion 203 or the reception circuit may be allowed up to ½ of the width "W".

In accordance with this embodiment, the length "L" and the width "W" of the reception antenna 201 are tuned so as to be fitted to the center frequency and the like of the reception signal by considering these aspects, and the reception antenna 201 is formed as the pattern on the reception-sided board 202. It could be confirmed that this reception antenna 201 can be operated under stable condition within a frequency range defined from 700 [MHz] to 3 [GHz], while this frequency range is, for example, a 900 [MHz]-range in which 906 [MHz] is a center frequency thereof.

In the above-described first and second embodiments, as a pattern forming method of the transmission antenna and/or the reception antenna, which are formed as the electric conducting patterns on the printed circuit board, the conventionally known methods may be used, for instance, the rolling method, the vapor deposition method, and the sputtering method.

In the above-explained first and second embodiments, both the length and the width of the transmission antenna and/or the reception antenna are tuned to be fitted to the center frequency used by the relevant frequency. Furthermore, since either a coil (inductor) or a capacitor is inserted into a base portion, an intermediate portion, or a summit portion of an antenna (for example, antenna is base-loaded by using loading coil), this antenna may be tuned to be fitted to a center frequency used by this antenna.

Furthermore, in the above-described first and second embodiments, as the printed circuit board (substrate) for forming the transmission antenna and/or the reception antenna, a substrate made of glass etc. may be employed, another substrate made of a ceramic material such as alumina ($Al_2O_3$), and steatite ($MgO.SiO_2$) may be employed, and another substrate using a material such as a substrate made of an organic material such as epoxy, phenol, paper epoxy, glass epoxy, and polyimide may be employed. Furthermore, alternatively, the transmission antenna and/or the reception antenna may be formed not only on a single layer of a substrate, but also on a multilayer of a substrate.

Effect of the Invention

As previously described, in accordance with this invention, the following effects may be achieved:

(1) The antenna of the this invention is formed on the printed circuit board as the electric conducting pattern having the length of ¼ (λ/4)±20 [%] of the wavelength, where the printed circuit board mounts thereon the transmission circuit used in the frequency range defined from 700 [MHz] to 3 [GHz]; and a portion of the antenna, which is longer than, or equal to ⅔ of the entire length of the antenna, owns the width wider than, or equal to λ/400. As a result, an antenna can be provided, whose antenna space can be made smaller than the conventional antenna space, and also whose total manufacturing stages can be reduced. Also, since the antenna of this invention is located within (inside) an outer housing (case) of a wireless information communication apparatus, for instance, even when a human touches any portion of the outer housing thereof, the antenna can be operated to transmit the information under stable condition without receiving a change in directivity and an adverse influence of a body effect and the like.

(2) The antenna is formed on the printed circuit board as the pattern, where portion of the antenna longer than, or equal to ⅔ of the entire length thereof is separated from either the ground portion or the transmission circuit, which are formed on the printed circuit board, longer than, or equal to λ/400. As a consequence, while the reflections of the transmission output can be extremely lowered, the antenna can be operated under further stable condition to transmit the information.

(3) The transmission output terminal portions are provided on the antenna and the ground portion, and the transmission output terminal portions are capable of measuring the transmission output from the transmission circuit; and the antenna is further comprised of the switching portion for switching as to whether or not the antenna is electrically conducted to the transmission circuit. As a result, for example, when the transmission circuit is tested and investigated, the antenna is electrically opened with respect to the transmission circuit by way of the switching portion so as to acquire the data from the transmission output termination portions, so that an antenna capable of measuring the transmission circuit and the like in an easier manner and also in high precision can be provided.

(4) The antenna of this invention is formed on the printed circuit board as the electric conducting pattern having the length of ¼ (λ/4)±20 [%] of the wavelength, where the printed circuit board mounts thereon the reception circuit used in the frequency range defined from 700 [MHz] to 3 [GHz]; and a portion of the antenna, which is longer than, or equal to ⅔ of the entire length of the antenna, owns the width wider than, or equal to λ/400. As a result, an antenna can be provided whose antenna space can be made smaller than the conventional antenna space, and whose total manufacturing stages can be reduced. Also, since the antenna of this invention is located within (inside) an outer housing (case) of a wireless information communication apparatus, for instance, even when a human touches any portion of the outer housing thereof, the antenna can be operated to transmit the information under stable condition without receiving a change in directivity and an adverse influence of a body effect and the like.

(5) The antenna is formed on the printed circuit board as the pattern, while the portion of the antenna longer than, or equal to ⅔ of the entire length thereof is separated from either the ground portion or the reception circuit, which are formed on the printed circuit board, longer than, or equal to λ/800. As a result, both the antenna which may occupy the area on the printed circuit board and the area of the portion related to this antenna can be furthermore made smaller, so that the size of the apparatus on which this antenna is mounted can be made compact.

(6) The reception input starting portions are provided on the antenna and the ground portion, where the reception input starting portions are capable of inputting the reception signal into the reception circuit; and the antenna is further comprised of the switching portion for switching as to whether or not the antenna is electrically conducted to the reception circuit. As a result, for example, when the reception circuit is tested and investigated, the antenna is electrically opened with respect to the reception circuit by way of the switching portion so as to acquire the data from the reception circuit by entering the data from the reception input starting portions, so that such an antenna capable of measuring the transmission circuit and the like in an easier manner and also in high precision can be provided.

As apparent from the above-described effects, an antenna can be provided that can be mounted on compact wireless information communication apparatus such as a portable telephone and a transceiver, and also can transmit/receive the information under stable condition and in high precision.

What is claimed is:

1. An antenna used in a frequency range defined from 700 MHz to 3 GHz wherein:

said antenna is formed on a printed circuit board as an electric conducting pattern having a length of ¼ (λ/4) ±20% of a wavelength, where said printed circuit board mounts thereon a transmission circuit used in said frequency range; and a portion of said antenna, which is longer than, or equal to ⅔ of an entire length of said antenna, owns a width wider than, or equal to λ/400.

2. An antenna as claimed in claim 1 wherein:

said portion of the antenna longer than, or equal to ⅔ of the entire length thereof is separated from either a ground portion or said transmission circuit, which are formed on said printed circuit board, by λ/400 or longer.

3. An antenna as claimed in claim 2 wherein:

transmission output terminal portions are provided on said antenna and said ground portion, where said transmission output terminal portions are capable of measuring a transmission output from said transmission circuit; and said antenna is further comprised of a switching portion for switching as to whether or not said antenna is electrically conducted to said transmission circuit.

4. An antenna used in a frequency range defined from 700 MHz to 3 GHz wherein:

said antenna is formed on a printed circuit board as an electric conducting pattern having a length of ¼ (λ/4) ±20% of a wavelength, where said printed circuit board mounts thereon a reception circuit used in said frequency range; and a portion of said antenna, which is longer than, or equal to ⅔ of an entire length of said antenna, owns a width wider than, or equal to λ/400.

5. An antenna as claimed in claim 4 wherein:

said portion of the antenna longer than, or equal to ⅔ of the entire length thereof is separated from either a ground portion or said reception circuit, which are formed on said printed circuit board, longer than, or equal to λ/800.

6. An antenna as claimed in claim 5 wherein:

reception input terminal portions are provided on said antenna and said ground portion, where said reception input terminal portions are capable of inputting a reception signal into said reception circuit; and said antenna is further comprised of a switching portion for switching as to whether or not said antenna is electrically conducted to said reception circuit.

* * * * *